US008654164B2

(12) United States Patent
Mochizuki et al.

(10) Patent No.: US 8,654,164 B2
(45) Date of Patent: Feb. 18, 2014

(54) PRINTING DEVICE AND PRINTING METHOD

(75) Inventors: Hiroshi Mochizuki, Yamanashi-ken (JP); Yuichi Aihara, Yamanashi-ken (JP); Tsuyoshi Kubota, Yamanashi-ken (JP)

(73) Assignees: Toppan Printing Co., Ltd., Tokyo (JP); Nisca Corporation, Minamikoma-gun, Yamanashi-Ken (JP)

( * ) Notice: Subject to any disclaimer, the term of this patent is extended or adjusted under 35 U.S.C. 154(b) by 19 days.

(21) Appl. No.: 13/497,685

(22) PCT Filed: Sep. 24, 2010

(86) PCT No.: PCT/JP2010/066504
§ 371 (c)(1), (2), (4) Date: Mar. 22, 2012

(87) PCT Pub. No.: WO2011/037163
PCT Pub. Date: Mar. 31, 2011

(65) Prior Publication Data

US 2012/0176460 A1 Jul. 12, 2012

(30) Foreign Application Priority Data

Sep. 25, 2009 (JP) ..... 2009-221672

(51) Int. Cl.
*B41J 2/325* (2006.01)

(52) U.S. Cl.
USPC ..... 347/213

(58) Field of Classification Search
USPC ..... 347/171, 177, 178, 213, 217; 400/120.01, 120.02, 240, 240.3, 240.4
See application file for complete search history.

(56) References Cited

U.S. PATENT DOCUMENTS

| | | | | |
|---|---|---|---|---|
| 6,801,236 | B2 * | 10/2004 | Araki et al. | 347/213 |
| 7,626,604 | B2 * | 12/2009 | Ihara | 347/213 |
| 8,174,550 | B2 * | 5/2012 | Mori | 347/213 |
| 2001/0010535 | A1 * | 8/2001 | Andoh et al. | 347/213 |
| 2008/0266374 | A1 * | 10/2008 | Mizukami et al. | 347/213 |
| 2009/0074948 | A1 | 3/2009 | Ihara et al. | |

FOREIGN PATENT DOCUMENTS

| | | |
|---|---|---|
| JP | 2005-131954 A | 5/2005 |
| JP | 2009-202373 A | 9/2009 |

* cited by examiner

*Primary Examiner* — Kristal Feggins
(74) *Attorney, Agent, or Firm* — Manabu Kanesaka

(57) ABSTRACT

The present invention provides a printing device which provides high printing quality. The printing device includes: an image forming section which has a thermal head 9 and a platen roller 12; a media conveyance section for conveying an intermediate transfer film F; a ribbon conveyance section for conveying an ink ribbon R; a sensor 10 for detecting a first mark formed on the film F; and a control section for controlling the image forming section, the media conveyance section, and the ribbon conveyance section in accordance with output information from the sensor 10. The control section presses the head 9 into contact with the roller 12 when the first mark is not detected, which is when the first mark is further upstream than the position of the sensor 10, while the film F and the ribbon R are being conveyed, and selectively heats a heating element formed in the head 9 when the film F is positioned in the printing start position, which is a state in which the first mark is detected when the first mark is further downstream than the position of the sensor 10.

14 Claims, 14 Drawing Sheets

PRINTING DEVICE AND PRINTING METHOD

RELATED APPLICATIONS

The present application is National Phase of International Application No. PCT/JP2010/066504 filed Sep. 24, 2010, and claims priority from Japanese Application No. 2009-221672 filed Sep. 25, 2009.

FIELD OF THE INVENTION

The present invention relates to a printing device and a printing method, and relates particularly to a printing device and a printing method for pressing a thermal head against a platen, through an ink ribbon, and forming an image on a film-shaped intermediate transfer medium, and for transferring the thus obtained image to a printing medium.

DESCRIPTION OF THE RELATED ART

Conventionally, for the production of a print medium, such as a credit card, a cash card, a license card or an ID card, a printing device is employed whereby a thermal head is pressed against a platen roller, via an ink ribbon, to form an image on a film-shaped intermediate transfer medium (an intermediate transfer film), and the thus obtained image is transferred to a print medium.

This printing device generally includes: an image forming section (a printing section), which has a thermal head and a platen roller, and is movable between a retracted position, where the thermal head and the platen roller are separated from each other, and a printing position, where the thermal head is pressed against the platen roller; an intermediate transfer film conveyance section, which conveys an intermediate transfer film; an ink ribbon conveyance section, which conveys an ink ribbon; a sensor, which detects marks formed on the intermediate transfer film and the ink ribbon at predetermined intervals; and a microcomputer, which provides control for the entire device based on a printing instruction that indicates an image is to be formed on the intermediate transfer film, or based on information output by the sensor.

For this type of printing device, in a state wherein the intermediate transfer film and the ink ribbon are positioned (with the printing start position aligned with the thermal head), the conveying of the intermediate transfer film and the ink ribbon is temporarily halted and the thermal head is moved from the retracted position to the printing position, and then, the winding of the intermediate transfer film and the ink ribbon is restarted and printing is performed (see, for example, paragraphs [0021] and [0022] in Japanese Patent Laid-Open No. 2009-72949).

The control operation shown in FIG. 11 is a typical example performed by a microcomputer for forming an image on an intermediate transfer film. Specifically, the operation waits until a printing instruction (a transfer request) has been issued (step 202); when a printing instruction has been issued, cueing of the intermediate transfer film and the ink ribbon is performed (step S204); slack in the intermediate transfer film that has appeared on the back tension side is removed (step 206); the thermal head is pressed against the platen roller (step 208); heating elements that are included in the thermal head are selectively heated, and concurrently, the intermediate transfer film and the ink ribbon are conveyed, to form an image on the intermediate transfer film (step 210); and the intermediate transfer film and the ink ribbon are rewound (step 212) to prepare for the next printing instruction.

However, as with the printing device in patent literature 1, when cueing of an intermediate transfer film F and an ink ribbon R have been performed (the state shown in FIG. 12), and thereafter, the intermediate transfer film F and the ink ribbon R are brought into contact with each other by using a thermal head 9 and a platen roller 12, the trajectories of the paths for conveying the intermediate transfer film F and the ink ribbon R are changed (see FIG. 13). That is, when the intermediate transfer film F and the ink ribbon R have been set in position, and thereafter, the thermal head 9 is pressed against the platen roller 12, the printing start position may be shifted.

Further, during image forming the intermediate transfer film is being wound, and for this winding of the intermediate transfer film, a stepping motor is generally employed. Conventionally, since printing was performed at a low speed, a constant revolution speed could be maintained for the motor from the time printing was initiated to the time completed (see FIG. 14). However, as the printing speed is being increased, the revolution speed of the motor is first accelerated, and then becomes stabilized (see FIG. 15). Therefore, when the intermediate transfer film and the ink ribbon have been set in position, and when conveying of the intermediate transfer film and the ink ribbon is temporarily halted and printing is started thereafter, a problem has arisen in that there is a difference in the printing density between immediately after the conveying of the intermediate transfer film and the ink ribbon is restarted and after the rotation of the motor has been stabilized.

Furthermore, in a case wherein printing (image forming relative to the intermediate transfer film) is to be performed after the intermediate transfer film and the ink ribbon have been aligned with each other, a problem encountered is that since when the conveying of the intermediate transfer film and the ink ribbon is halted (positioning having been completed) a slackness develops in the ink ribbon, and the back tension that is to be provided for the intermediate transfer film and the ink ribbon is not stable.

SUMMARY OF THE INVENTION

While taking the above described problems into account, one objective of the present invention is to provide a printing device that produces high quality printing and a printing method therefor.

In order to achieve the above objective, according to a first aspect of the present invention, a printing device, for pressing a thermal head and a platen against each other, via an ink ribbon, to form an image on a film-shaped intermediate transfer medium, and for transferring the thus obtained image to a printing medium, comprises: a printing section, including the thermal head and the platen, and being movable between a retracted position, whereat the thermal head and the platen are separated, and a printing position, whereat the thermal head and the platen are pressed against each other; an intermediate transfer medium conveyance section, for conveying the intermediate transfer medium; an ink ribbon conveyance section, for conveying the ink ribbon; a first mark detection section, for detecting a first mark formed on the intermediate transfer medium; and a control section, for controlling the printing section, the intermediate transfer medium conveyance section and the ink ribbon conveyance section based on information output by the first mark detection section, wherein the control section permits the intermediate transfer medium conveyance section and the ink ribbon conveyance section to convey the intermediate transfer medium and the ink ribbon, and concurrently controls the printing section by monitoring information output by the first mark detection section, so that the printing section is moved to the printing position in a state wherein the first mark has not yet been detected, i.e., wherein the first mark is present upstream of a position where the first mark detection section is arranged, or that heating elements included in the thermal head are selectively heated in a state wherein the first mark has been detected, i.e., wherein the first mark is located downstream of the position whereat the first mark detection section is arranged, and when, or after, the intermediate transfer medium has reached a printing start position.

For the first aspect, a second mark detection section for detecting a second mark formed on the ink ribbon may be further included; and the control section may monitor information output by the first and second mark detection sections to control the intermediate transfer medium conveyance section and the ink ribbon conveyance section and also control the printing section, so that in the state wherein the first mark has not yet been detected, a predetermined position of the ink ribbon is aligned with a predetermined position of the intermediate transfer medium, and thereafter the printing section is moved to the printing position, or that in the state wherein the first mark has been detected, i.e., wherein the first mark is present downstream of the position whereat the first mark detection section is arranged, and when, or after, the intermediate transfer medium and the ink ribbon have reached the printing start position, the heating elements included in the thermal head are selectively heated. Furthermore, it is preferable that the control section permit the printing section to pre-electrify the thermal head after the first mark detection section has detected the first mark and before the heat elements included in the thermal head are to be selectively heated. Further, the ink ribbon may be provided by applying a plurality of ink colors in sequential panels; and after printing of one color has been completed, the control section may move the printing section to the retracted position, and may monitor information output by the first and second mark detection sections and control the intermediate transfer medium conveyance section and the ink ribbon conveyance section, so that the intermediate transfer medium is conveyed in a reverse direction until the first mark reaches a position upstream of the position whereat the first mark detection section is arranged, in a direction in which the intermediate transfer medium is conveyed during image forming, and that the predetermined position of the ink ribbon for the following ink color is aligned with the predetermined position of the intermediate transfer medium. At this time, the second mark may be formed using one of the plurality of ink colors that are applied in the sequential panels.

Further, to achieve the above objective, according to a second aspect of the present invention, a printing device, for pressing a thermal head and a platen against each other, via an ink ribbon, to form an image on a film-shaped intermediate transfer medium, and for transferring the thus obtained image to a printing medium, comprises: a printing section, including the thermal head and the platen, and being movable between a retracted position, whereat the thermal head and the platen are separated, and a printing position, whereat the thermal head and the platen are pressed against each other; an intermediate transfer medium conveyance section, for conveying the intermediate transfer medium; an ink ribbon conveyance section, for conveying the ink ribbon; a first mark detection section, for detecting a first mark formed on the intermediate transfer medium; and a control section, for controlling the printing section, the intermediate transfer medium conveyance section and the ink ribbon conveyance section based on information output by the first mark detection section, wherein the control section controls the printing section, the intermediate transfer medium conveyance section and the ink ribbon conveyance section, so that when the first mark detection section has detected the first mark, the printing section is moved to the printing position, and thereafter, when the first mark has been detected by the first mark detection section during conveyance of the intermediate transfer medium and the ink ribbon to the printing section, a printing process is begun, while conveying of the intermediate transfer medium and the ink ribbon is continued.

For the second aspect, the control section may control the printing section and the intermediate transfer medium conveyance section, so that after the first mark detection sensor has detected the first mark and before the printing section is to be moved to the printing position, the intermediate transfer medium is conveyed to a location for which a relationship $L1>L2$ is established, where L1 denotes a distance from a leading edge of a printing area to the printing section and L2 denotes a distance from the first mark to the first mark detection section. Further, a second mark detection section for detecting a second mark formed on the ink ribbon may be included; and the control section may control the intermediate transfer medium conveyance section and the ink ribbon conveyance section, so that after the first mark detection sensor has detected the first mark and before the printing section is to be moved to the printing position, the intermediate transfer medium and the ink ribbon are conveyed to a location for which a relationship $L1>L2$ and $L1=L3$ is established, where L2 denotes a distance from the leading edge of the printing area to the printing section, L2 denotes a distance from the first mark to the first mark detection section, and L3 denotes a distance from the printing start position of the ink ribbon to the printing section. In this case, the ink ribbon may be provided by applying a plurality of ink colors in sequential panels; and after the printing of one color has been completed, the control section moves the printing section to a retracted position, permits the intermediate transfer medium conveyance section to perform reverse conveying of the intermediate transfer medium until the first mark passes the first mark detection section, and permits the ink ribbon conveyance section to convey the ink ribbon, based on information output by the second mark detection section, to a position such that a distance from the printing start position for the next color of the ink ribbon to the printing section is equal to L1. At this time, the second mark may be formed using at least one of the plurality of ink colors applied in sequential panels.

Moreover, to achieve the above described objective, according to a third aspect of the present invention, a printing method, for pressing a thermal head and a platen against each other via an ink ribbon to form an image on a film-shaped intermediate transfer medium, and for transferring the obtained image to a printing medium, comprises: a detection step of conveying the intermediate transfer medium and detecting a first mark formed on the intermediate transfer medium while the thermal head and the platen are not pressed against each other; a pressing step of employing first mark detection information, obtained at the detection step, and pressing one of the thermal head and the platen against the other via the ink ribbon and the intermediate transfer medium; a conveyance step of conveying the ink ribbon and the intermediate transfer medium while the thermal head and the platen are pressed against each other; a re-detection step of again detecting the first mark formed on the intermediate transfer medium; and an image forming step of employing first mark detection information, obtained at the re-detection step, and beginning image forming on the intermediate transfer medium while the thermal head and the platen are pressed against each other, wherein, when conveying of the ink ribbon and the intermediate transfer medium has begun at the conveyance step, the mark re-detection step and the image forming step are performed, without halting the conveying of the intermediate transfer medium and the ink ribbon.

For the third aspect, an alignment step of detecting a second mark, formed on the ink ribbon, to align the intermediate transfer medium and the ink ribbon may be included before the pressing step. In order to perform so-called color printing, a plurality of ink colors that are employed to form a plurality of color images on the intermediate transfer medium may be applied to the ink ribbon in sequential panels and, in addition, the second mark for position detection may be formed on the ink ribbon, and the image forming step may include a contact pressure release step of, after image forming for the intermediate transfer medium has been completed using one of the plurality of ink colors on the ink ribbon, releasing a pressure that is applied to hold the thermal head and the platen in contact with each other; a moving step, in a state wherein a contact pressure applied to the thermal head and the platen has been released, of moving the intermediate transfer medium upstream of a pressure-contact position whereat the thermal head and the platen are pressed against each other; an alignment step of detecting the first mark formed on the intermediate transfer medium and the second mark formed on the ink ribbon, and of aligning the intermediate transfer medium with the ink ribbon; a re-contact pressing step of employing first mark detection information, obtained at the alignment step, and again pressing one of the thermal head and the platen against the other via the ink ribbon and the intermediate transfer medium; a conveyance step of conveying the ink ribbon and the intermediate transfer medium while the thermal head and the platen are pressed against each other; a re-detection step of again detecting the first mark formed on the intermediate transfer medium; and a succeeding ink image forming step, in a state wherein the thermal head and the platen are again pressed into contact with each other, of employing first mark detection information, obtained at the re-detection step, and beginning image forming for the intermediate transfer medium, using an ink color following the one color, of the plurality of ink colors that are applied to the ink ribbon in sequential panels. At this time, the second mark may be formed with at least one of the plurality of ink colors applied in sequential panels.

According to the present invention, when or after the intermediate transfer medium and the ink ribbon that are conveyed have reached the printing start position, conveying of them is still continued (without being halted) and selective heating of the heating elements included in the thermal head is performed for image forming on the intermediate transfer medium. Therefore, the printing start position of the intermediate transfer medium will not be shifted due to a change in the trajectory that is caused by pressing the thermal head and the platen against each other. Further, since conveying of the intermediate transfer medium and the ink ribbon is not halted until image forming has been completed, the conveyance speed for the intermediate transfer conveyance and the ink ribbon is stabilized, a slackness does not occur in the intermediate transfer medium and the ink ribbon, and a stable back tension is obtained, so that an improvement in the printing quality can effectively be obtained.

DETAILED DESCRIPTION OF THE PREFERRED EMBODIMENTS

A description will now be given for embodiments wherein the present invention is applied for a printing device that performs printing by transferring images to a card type recording medium (hereinafter referred to as a card).

Configuration

Figure 1:
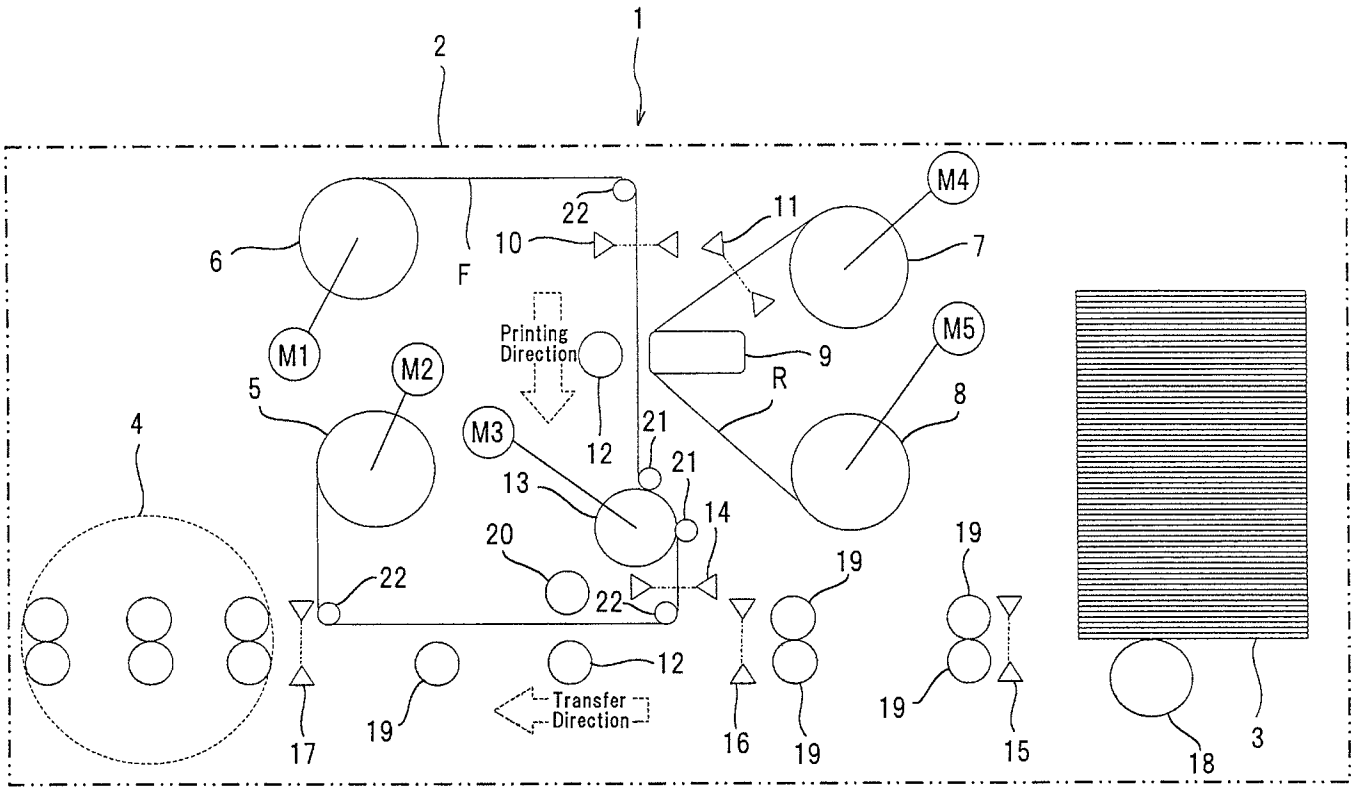
FIG. 1 is a schematic front view showing the configuration of a printing device for one embodiment, for which the present invention can be applied.

As illustrated in FIG. 1, for a printing device 1 of one embodiment of this invention, a cabinet 2 employed as a housing includes: a card supply section 3, which is a card supply source; a card conveyance section that conveys a card, supplied from the card supply section 3, along a substantially horizontal, linear card conveyance path; a card rotation section 4, which is located at the end of the card conveyance section opposite the card supply section 3, and while nipping (sandwiching) a card, rotates the card at a predetermined angle; an image forming section that serves as a printing section including a thermal head 9 and a platen roller 12; an intermediate transfer film conveyance section that conveys an intermediate transfer film F that is an intermediate transfer medium; an ink ribbon conveyance section that conveys an ink ribbon R; an image transfer section that transfers to a card an image formed on the intermediate transfer film F; various sensors that obtain positioning information; and a control section 40 that controls the entire printing device 1.

<Card Supply Section>

The card supply section 3 includes a card stacker, in which a plurality of blank cards are stacked. At the position where the card stacker faces the card conveyance path, a stacker side plate 26 (see FIG. 2) is arranged, in which a slot is formed so as to permit the passage of only a single card at a time, and a card supply roller 18 is provided in contact with the bottom of the card stacker, so that in consonance with the rotation of the card supply roller 18, blank cards stored in the card stacker are supplied one by one, beginning with the bottommost one, to the substantially horizontal, linear card conveyance path.

<Card Conveyance Section>

For conveying a card along the card conveyance path, the card conveyance section includes: a first card conveyance roller pair consisting of a card conveyance drive roller 19, arranged downstream, and a card conveyance slave roller 19, arranged upstream; a second card conveyance roller pair consisting of a card conveyance drive roller 19 and a card conveyance slave roller 19, arranged downstream of the first card conveyance roller pair; a platen roller 27 (which also serves as a constituent of the image transfer section) arranged downstream of the second card conveyance roller pair; and a card conveyance drive roller 19 arranged downstream of the platen roller 27.

Further, a cleaning roller 30 (see FIG. 2), the surface of which is coated with a viscous material, is provided in contact with the card conveyance slave roller 19 of the first card conveyance roller pair in order to clean the card conveyance slave roller 19 (and the surface of a card). Furthermore, a card supply sensor 15 is arranged upstream, in the card conveyance direction, in the vicinity of the first card conveyance roller pair, a card positioning sensor 16 is arranged downstream, in the card conveyance direction, in the vicinity of the second card conveyance roller pair, and a card rotation positioning sensor 17 is arranged at the lowermost position of the card conveyance section on the upstream side of the card rotation section 4. These sensors can be provided, for example, using thru-beam sensors or reflective sensors, and are employed to detect the edges of a card that is being conveyed along the card conveyance path.

<Card Rotation Section>

The card rotation section 4 includes two pinch roller pairs for gripping both ends of the card and a slave roller pair for holding the center portion, and the entire card rotation section 4 and these pinch roller pairs are independently rotated in order to prevent the card from being displaced by rotating the roller pairs together with the card. It should be noted that a state wherein a card is rotated 90° (or 270°) is also shown in FIG. 2, and rollers indicated by hatching are drive rollers, while rollers without hatching are slave rollers.

Figure 2:
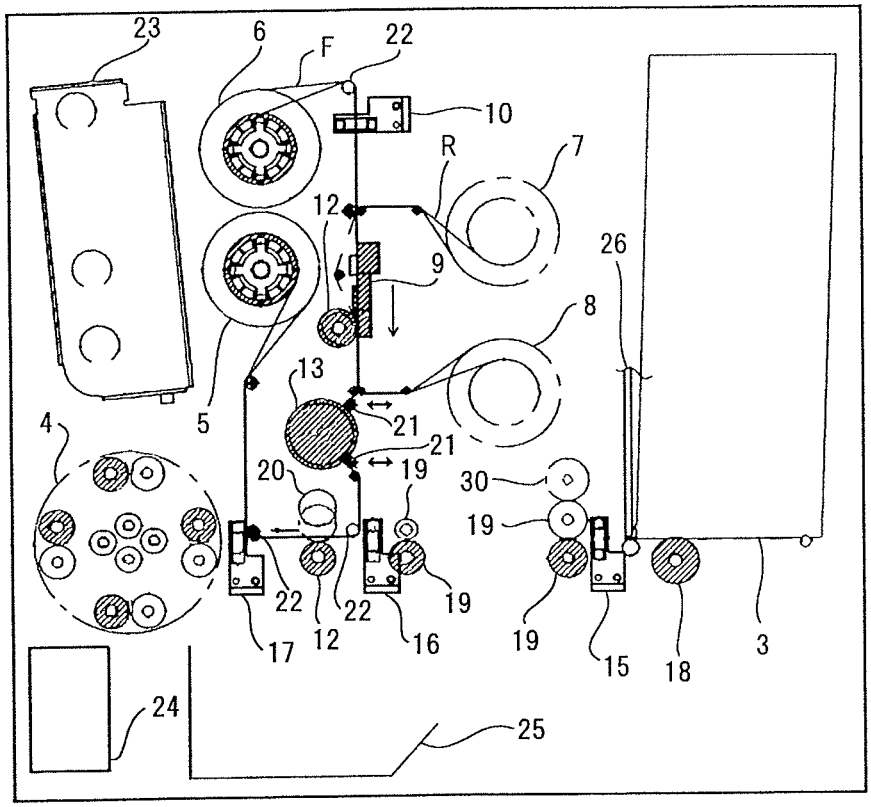
FIG. 2 is a front view showing the arrangement of the printing device of the embodiment.

As shown in FIG. 2, the arrangement around the card rotation section 4 includes: a magnetic writing section 23, which magnetically records information on a magnetic stripe in a case wherein a card is a magnetic tape, and also reads and verifies recorded magnetic information (magnetic identification); an IC writing section 24, which stores electronic information on an incorporated IC in a case wherein a card is an IC card, and also reads and verifies recorded electronic information; and an eject box 25, to which, when it is determined, through verification, that a magnetic card or an IC card is defective, the defective card is abandoned and collected. When the card rotation section 4 is rotated a predetermined angle, a card that is being held can be positioned toward the acceptance opening of the magnetic writing section 23, the IC writing section 24 or the eject box 25, and when two pinch roller pairs are rotated, the card can be conveyed toward one of the acceptance openings. It should be noted that the acceptance openings of the magnetic writing section 23 and the IC writing section 24 are located along a straight line extended from the center of the card rotation section 4.

<Image Forming Section>

Figure 6:
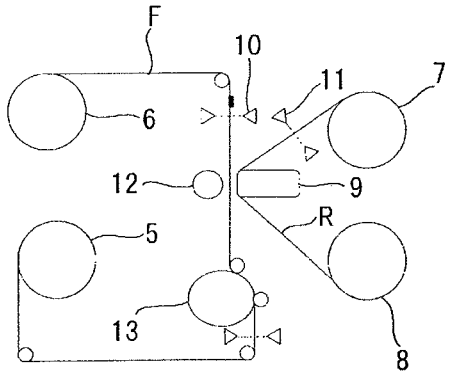
FIG. 6 is a schematic operational explanatory diagram showing a conveyance of the intermediate transfer film and the ink ribbon, with (A) showing a state wherein a first mark formed on the intermediate transfer film is present upstream of a first mark detection sensor in a conveyance direction employed for image forming (printing), and wherein the first mark detection sensor has not yet detected the first mark, (B) showing a state wherein the first mark is present upstream of the first mark detection sensor in the conveyance direction employed for image forming, and wherein a thermal head has been moved to a printing position, (C) showing a state wherein the first mark has been detected by the first mark detection sensor, and the intermediate transfer film is present before a printing start position, and wherein pre-electrifying of the thermal head is started, (D) showing a state wherein the intermediate transfer film and the ink ribbon shown in (C) were further conveyed, and have reached their printing start positions, (E) showing a state wherein printing has been completed, and (F) showing a state wherein the thermal head has been moved to a retracted position and the intermediate transfer film and the ink ribbon are being rewound.
Figure 6:
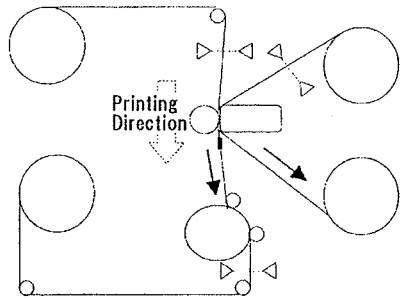
Figure 6:
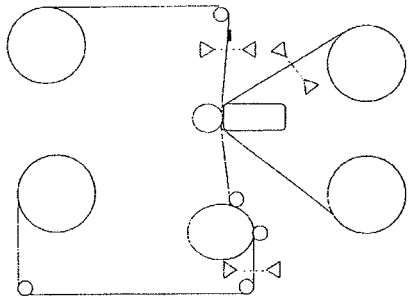
Figure 6:
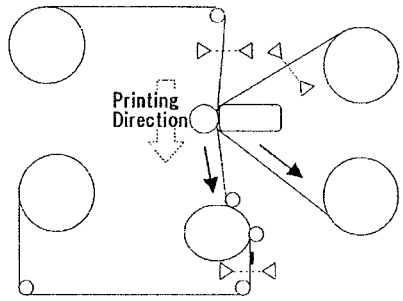
Figure 6:
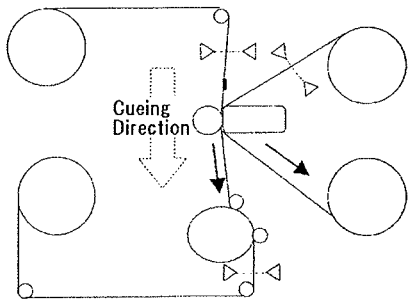
Figure 6:
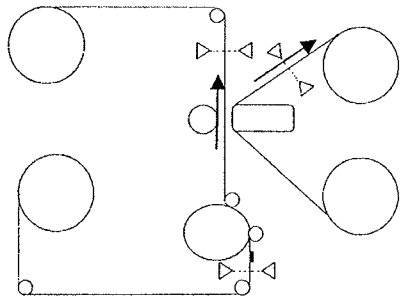

As shown in FIG. 1, the image forming section is provided so movable between a retracted position (a state shown in FIG. 1), at which the thermal head 9 is separated from the platen roller 12, which is arranged at a fixed position to be rotatable, and a printing position at which the thermal head 9 is pressed against the platen roller 12 (a position at which the thermal head 9 is brought into contact with the outer surface of the platen roller 12 via the intermediate transfer film F and the ink ribbon R; see FIG. 6(B), for example). As shown in FIG. 1, the intermediate transfer film F and the ink ribbon R, both of which will be described later, are present between the platen roller 12 and the thermal head 9. Based on an instruction issued by the control section 40 (a printing instruction for information relative to images, characters, etc., stored in a buffer memory 40G (see FIG. 3)), the image forming section selectively heats heating elements included in the thermal head 9 at the printing position, and forms an image (a mirror image) on the intermediate transfer film F using the ink ribbon R.

<Intermediate Transfer Film Conveyance Section>

Figure 15:
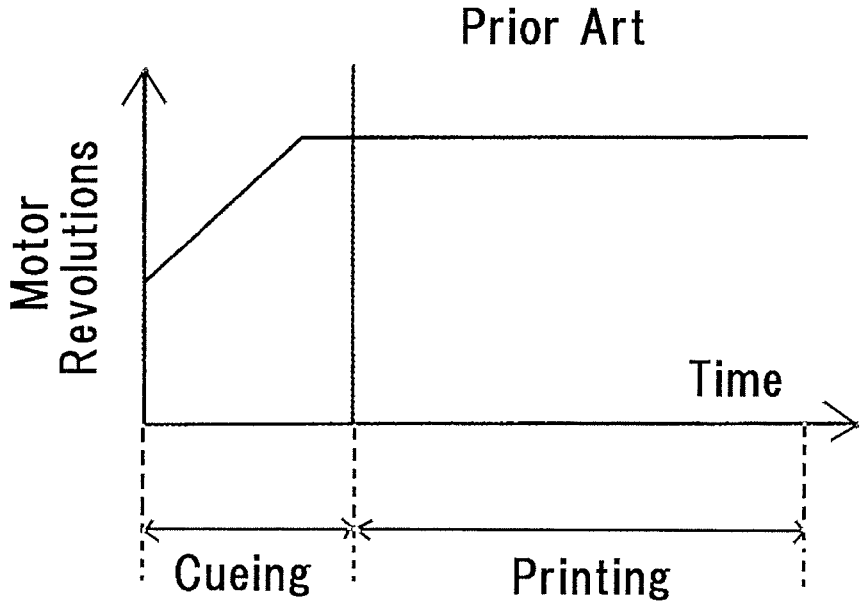
FIG. 15 is a characteristic diagram showing a relationship, relative to time, of the revolutions of a high-speed motor that serves as a drive source for conveying the intermediate transfer film of the conventional printing device.

The intermediate transfer film conveyance section includes: a film supply portion 5, for supplying the intermediate transfer film F; a film winding portion 6, for winding the intermediate transfer film F; and a primary film conveyance roller 13, which is one part of the intermediate transfer medium conveyance section that highly accurately conveys the intermediate transfer film F. As drive sources, a DC motor M1 that can rotate at high speed forward or in reverse is allocated for rotation of the spool shaft of the film supply portion 5, a DC motor M2 that can rotate at high speed forward or in reverse is allocated for rotation of the spool shaft of the film winding portion 6, and a stepping motor M3 that can rotate at high speed forward or in reverse is allocated for rotation of the primary film conveyance roller 13. It should be noted that, as shown in FIG. 15, feeding and positioning is performed at the time these high-speed motors are accelerated, and printing is performed when a constant drive velocity has been attained. The primary film conveyance roller 13 is employed not only for conveying the intermediate transfer film F when the image forming section performs image forming (printing) for the intermediate transfer film F, but also for controlling back tension for the intermediate transfer film F when the image transfer section transfers to a card an image that has been formed on the intermediate transfer film F.

Further, the intermediate transfer film conveyance section includes: a plurality of rollers for changing a conveyance direction during the conveying of the intermediate transfer film F; and two nip rollers 21 that can be moved between nip positions, at which the nip rollers 21 are pressed against the primary film conveyance roller 13 via the intermediate transfer film F, and retracted positions, where these rollers are separated from the primary film conveyance roller 13. For moving the nip rollers 21 between the nip positions and the retracted positions, a magnetic plunger, for example, can be employed as a drive source.

Below the roller 22 arranged in the vicinity of the film winding portion 6, a first mark detection sensor 10 is arranged as a part of a first mark detection section that detects a mark formed on the intermediate transfer film F (hereinafter, this mark is referred to as a first mark). Between this roller 22 and one of the nip rollers 21 that is located closer to this roller 22, the intermediate transfer film F is conveyed substantially vertically. Further, also between the other nip roller 21 and the roller 22 located below, the intermediate transfer film F is conveyed substantially vertically. A transfer positioning sensor 14 is arranged between these two rollers in order to detect the mark on the intermediate transfer film F when an image formed on the intermediate transfer film F is to be transferred to a card. Between this roller 22 and the roller 22 that is located in the vicinity of the film supply portion 5, the intermediate transfer film F is conveyed substantially horizontally (for the sake of convenience, a portion where the intermediate transfer film F is conveyed almost horizontally is referred to as a horizontal conveyance portion). It should be noted that as well as the above described sensor, the first mark detection sensor 10 and the transfer positioning sensor 14 can also be provided using, for example, thru-beam sensors or reflective sensors.

<Intermediate Transfer Film>

Figure 4:
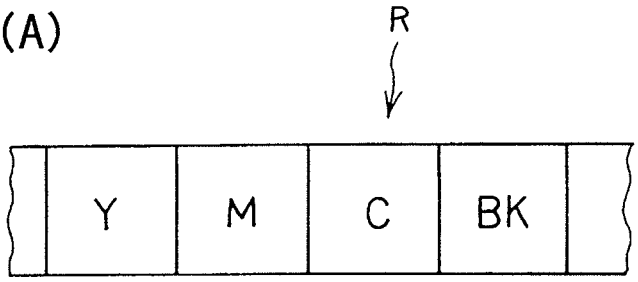
FIG. 4 is an explanatory diagram for an ink ribbon and an intermediate transfer film, with (A) being a schematic front view of the ink ribbon and (B) being a schematic cross-sectional view of the intermediate transfer film.
Figure 4:
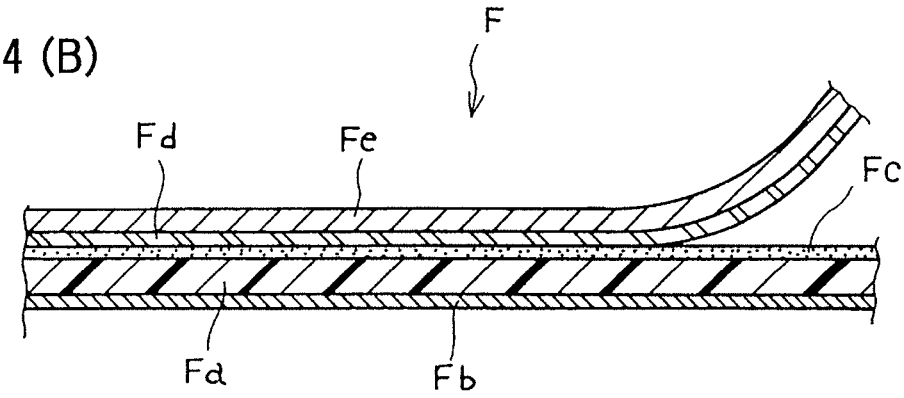

As shown in FIG. 4(B), the intermediate transfer film F is formed of a base film Fa, a back coat layer Fb, which is deposited on the reverse side of the base film Fa, an absorption layer Fe, where ink is absorbed, and an overcoat layer Fd, for protecting the surface of the absorption layer Fe, and a release layer Fc, which is deposited on the obverse side of the base film Fa, and when heated, promotes both the overcoat layer Fd and the absorption layer Fe to be released together from the base film Fa, and these layers are laminated, beginning from the bottom, in the order of the back coat layer Fb, the base film Fa, the release layer Fc, the overcoat layer Fd and the absorption layer Fe. The intermediate transfer film F is conveyed almost vertically, so that the absorption layer Fe side of the intermediate transfer film F faces the ink ribbon R, and the back coat layer Fb side contacts the platen roller 12. It should be noted that, although disregarded in FIG. 4(B), the above described first mark is linearly formed, at each predetermined interval of one image plane, which is equivalent in size to a card, in a direction, as shown in FIG. 7(A), for example, perpendicular to the longitudinal direction of the intermediate transfer film F.

<Ink Ribbon Conveyance Section>

As shown in FIG. 1, the ink ribbon conveyance section includes a ribbon supply potion 7, for feeding the ink ribbon R, and a ribbon winding portion 8, for winding the ink ribbon R. DC motors M4 and M5 that can rotate forward or in reverse at a high speed are employed, respectively, as drive sources to rotate the spool shafts of the ribbon supply portion 7 and the ribbon winding portion 8. It should be noted that for these high-speed motors, as well as the motors M1 to M3, feeding and positioning is performed at the time of acceleration, and printing is performed when a constant drive velocity has been attained.

Between the ribbon supply portion 7 and the thermal head 9, a second mark detection sensor 11 is arranged as part of a second mark detection section that detects a position detection mark formed on the ink ribbon R (hereinafter, this mark is referred to as a secondmark. In this embodiment, the Bk of the ink ribbon B is employed for the second mark). This second mark detection sensor 11, as well as the above described sensors, can also be provided, for example, using a thru-beam sensor or a reflective sensor. The position of the ink ribbon R is controlled by detecting the second mark using the second mark detection sensor 11. Referring to the schematic diagram in FIG. 1, it seems that the ink ribbon R is obliquely conveyed; however, since the ink ribbon R is formed using a plurality of colors, as will be described below, actually, as shown in FIG. 2, the ink ribbon B is conveyed almost vertically, in the same manner as is the intermediate transfer film F, in order to prevent position shifting during image forming (in order to improve the printing quality).

<Ink Ribbon>

As shown in FIG. 4(A), the ink ribbon R is, for example, a belt-shaped film, to which Y (yellow), M (magenta), C (cyan) and Bk (black) of ink have been repeatedly applied, in a sequential panel manner, in a width slightly greater than that of the longitudinal length of a card C.

<Image Transfer Section>

As shown in FIG. 1, the image transfer section is located upstream of the card conveyance drive roller 19, which is not one of those included among the roller pairs located in the above described horizontal conveyance portions, but is independently located. The image transfer section includes: the platen roller 27, for supporting a card when image transferring, from the intermediate transfer film F to the card, is performed; and a heat roller 20 that is arranged to be moved forward or backward, between a forward position and a retracted position, relative to the platen roller 27. The heat roller 20 incorporates a heating lamp (not shown) for heating the intermediate transfer film F. The platen roller 27 and the heat roller 20 are arranged with the intermediate transfer film F positioned between the two. A cam, for example, can be employed to move the heat roller 20 forward or backward.

<Control Section>

Figure 3:
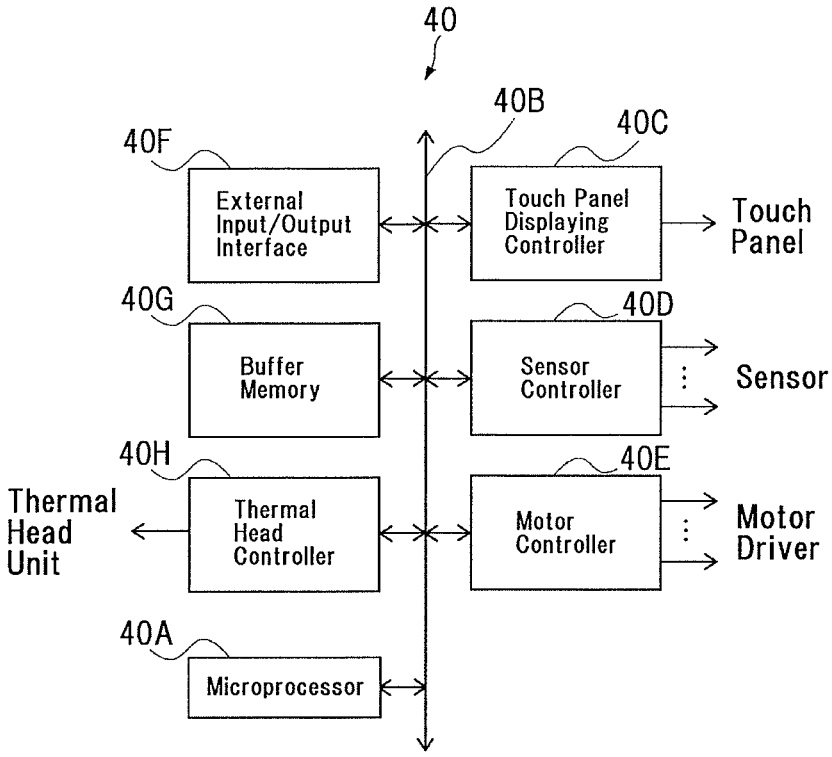
FIG. 3 is a detailed block diagram showing the control section of the printing device of the embodiment.

As shown in FIG. 3, the control section 40 has a microcomputer 40A that performs the control process for the printing device 1. The microcomputer 40A includes: a CPU that operates at high clock rates as a central processing unit; a ROM, in which the control operation for the printing device 1 is stored; a RAM that is employed as a work area by the CPU; a nonvolatile memory, such as a flash memory or an EEPROM; and an internal bus that connects these components.

An external bus 40B is connected to the microcomputer 40A, and a touch panel display controller 40C, which exercises control for the display of a touch panel (an input display unit) that is not shown and for instructions that are entered, a sensor controller 40D, which controls signals transmitted by various sensors, a motor controller 40E, which provides control for the driving of the individual motors, an external input/output interface 40F, which is employed to communicate with an external apparatus such as a host computer, a buffer memory 40G, in which image information, etc., to be printed on a card is temporarily stored, and a thermal head controller 40H, which controls the thermal energy of the thermal head 9, are connected to the external bus 40B. Further, although disregarded in FIG. 3, an actuator controller, which controls an actuator, etc., that moves between the nip positions and the retracted portions of the nip rollers 21, is also connected.

The printing device 1 is to be operated based on an instruction entered on the above described touch panel, and can also be operated upon reception of an instruction from the above described external apparatus via the external input/output interface 40F. It should be noted that the printing device 1 includes a power supply section, which supplies operating power to the above described individual sections, and a power storage device (e.g., a button-type lithium-ion battery), which is connected to the power supply section and serves as a power supply source that ensures operating time for the writing of necessary information to the nonvolatile memory when the supply of commercial power is interrupted.

Operation

Figure 5:
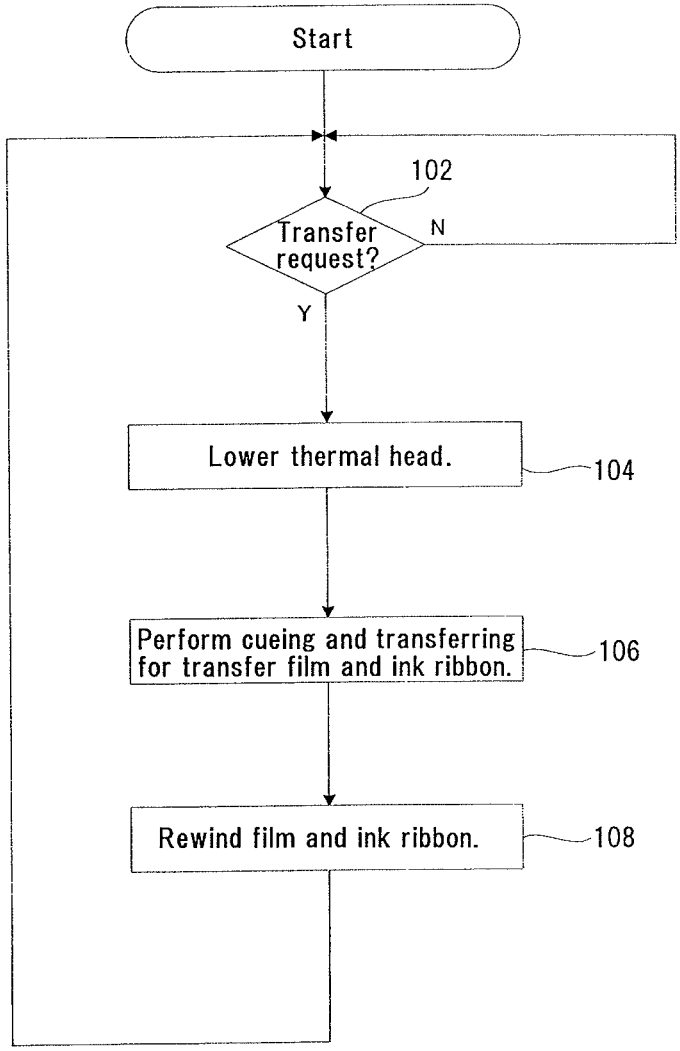
FIG. 5 is a flowchart for a printing routine performed by the microcomputer of the control section of the printing device in the embodiment.

The operation of the printing device 1 of this embodiment will now be described by referring to a flowchart, while the CPU of the microcomputer 40A of the control section 40 (hereinafter abbreviated as a CPU) is employed as a core. It should be noted that when power is supplied to the control section 40, and before the printing routine in FIG. 5 is begun, the CPU performs an initial setup process, for loading a program and program data from the ROM to the RAM and for positioning the above described individual sections at the home positions, and a confirmation process for monitoring information output by an empty sensor (not shown) to determine whether cards are stored in the card supply section 3 and for monitoring information output by the above described various sensors to determine whether the intermediate transfer film F and the ink ribbon R have been loaded, and for, in a case wherein either storage of cards or loading of the film and the ribbon has not yet been performed, generating an audible alarm and displaying a message to that effect on the above described touch panel, and further, transmitting a notification to that effect to the external apparatus, in a case wherein the operation is to be performed based on an instruction issued by the external apparatus, and for performing a check to determine whether cards are stored and whether the intermediate transfer film F and the ink ribbon R are loaded, and thereafter, the CPU employs data in the nonvolatile memory to convey the intermediate transfer film F and the ink ribbon R to the initial positions where they can be employed. Furthermore, to simplify the explanation, it is assumed that YMC color separated image information and control information, which have been received from the external apparatus via the external input/output interface 40F, are stored in the buffer memory 40G of the control section 40, the thermal head 9 is located at the retracted position, and a printing instruction is to be issued by the external apparatus.

During the printing routine, first, at step S102, the operation waits until a printing instruction (a transfer request) is received, and when a printing instruction is received, the motor M1 is driven to begin conveying the intermediate transfer film F, which is to be wound around the film winding portion 6, and the motor M5 is driven to begin conveying the ink ribbon R, which is to be wound around the ribbon winding portion 8 (disregarded in FIG. 5). At this time, the first mark for cueing (position detection), which is formed on the intermediate transfer film F, passed the first mark detection sensor 10, and has reached a position upstream in a direction in which the intermediate transfer film is to be conveyed for image forming (this position is referred to as the initial position of the intermediate transfer film F). In this state, the thermal head 9 is located at the retracted position (the thermal head 9 and the platen roller 12 are not in contact with each other), the first mark is located upstream of the first mark detection sensor 10 in the conveyance direction employed for image forming, and the first mark detection sensor 10 has not yet detected the first mark (in the cueing operation for the intermediate transfer film F in the image forming process) (see FIG. 6(A); it should be noted that, in (A) to (F) of FIG. 6, the position of the first mark formed on the intermediate transfer film F for one image plane is indicated by a solid line). Further, since the position of the ink ribbon R is managed by the second mark detection sensor 11, the ink ribbon R is so positioned that the leading edge of a Y color panel on the ink ribbon R corresponds to the printing start position of the intermediate transfer film F (this position is referred to as the initial position for the ink ribbon R). In other words, the initial positions of the intermediate transfer film F and the ink ribbon R are so designated that a distance between the pressure-contact position, whereat the thermal head 9 and the platen 12 are pressed against each other, and the image forming position (the broken line portion in FIG. 7) indicated by the initial position of the intermediate transfer film F, is equal to a distance between the pressure-contact position and the leading edge of the Y color panel of the ink ribbon R.

At the following step 104, the thermal head 9 is moved to the printing position. In this state, the first mark is still located upstream of the first mark detection sensor 10 in the conveyance direction employed for image forming, and the first mark detection sensor 10 has not yet detected the first mark (see FIG. 6(B)).

Subsequently, at step 106, while the intermediate transfer film F and the ink ribbon R are being conveyed (in the conveyance direction employed for image forming), information (a signal) output by the first mark detection sensor 10 is monitored to determine whether the first mark detection sensor 10 has detected the first mark, and when this determination is negative, monitoring is continued, or when this determination is positive, cueing is performed by further conveying the intermediate transfer film F and the ink ribbon R a predetermined distance. It should be noted that the ink ribbon R and the intermediate transfer film F are conveyed the same distance at the same time. In this state, the intermediate transfer film F (strictly speaking, the portion of the intermediate transfer film F for one image plane, for which image forming is to be performed) is located upstream of the printing start position (a position at which image forming for the intermediate transfer film F is started by selectively heating, relative to the ink ribbon R, the heating elements that are included in the thermal head 9), and pre-electrifying of the thermal head 9 is begun (see FIG. 6(C)). It should be noted that for pre-heating of the thermal head 9, the individual heating elements are heated to near the upper limit temperature where coloring does not occur, i.e., ink on the ink ribbon R can not be transferred to the intermediate transfer film F. This pre-electrifying is performed to prevent degradation of a printing quality that occurs because, even when the heating elements of the thermal head 9 are selectively heated immediately after the intermediate transfer film F has reached the printing start position, the condition of the heating elements can not catch up with the operation.

Figure 7:
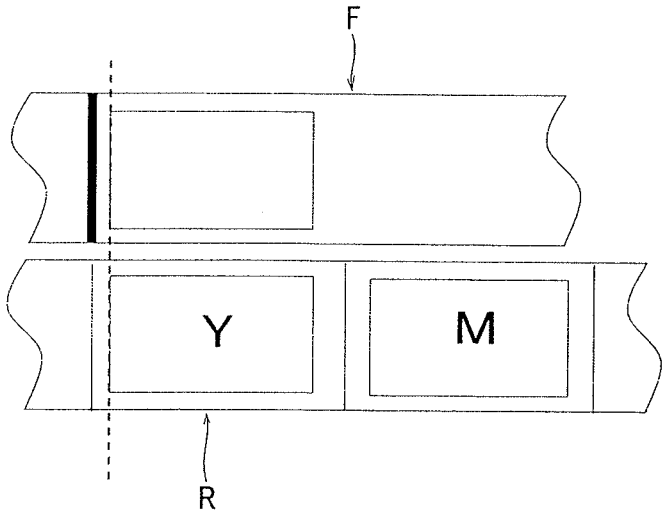
FIG. 7 is a schematic explanatory diagram showing a relationship between the printing start position for the ink ribbon and the printing start position for the intermediate transfer film, with (A) showing a relationship between the printing start position assigned for one image plane of the intermediate transfer film and the printing start position for Y (yellow) on the ink ribbon, and (B) showing a relationship between the printing start position for one image plane of the intermediate transfer film and the printing start position for M (magenta) on the ink ribbon, which follows Y in the sequential panel arrangement.
Figure 7:
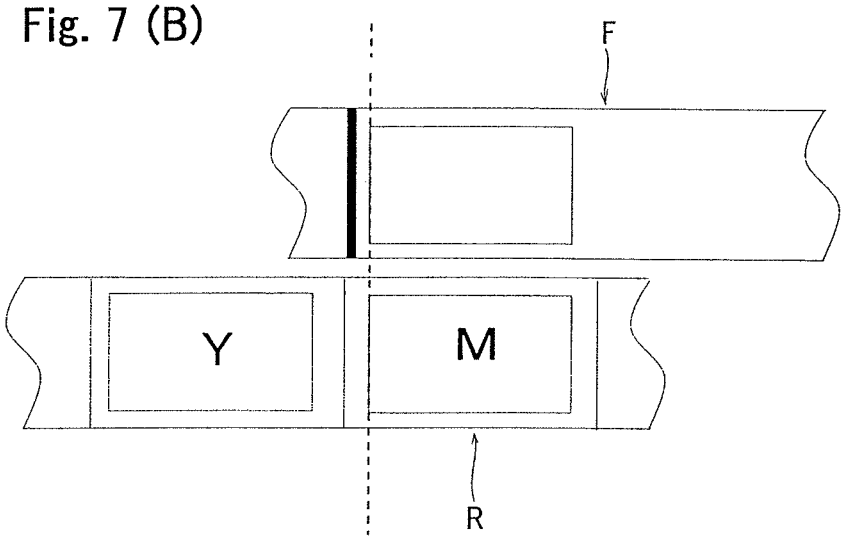
Figure 8:
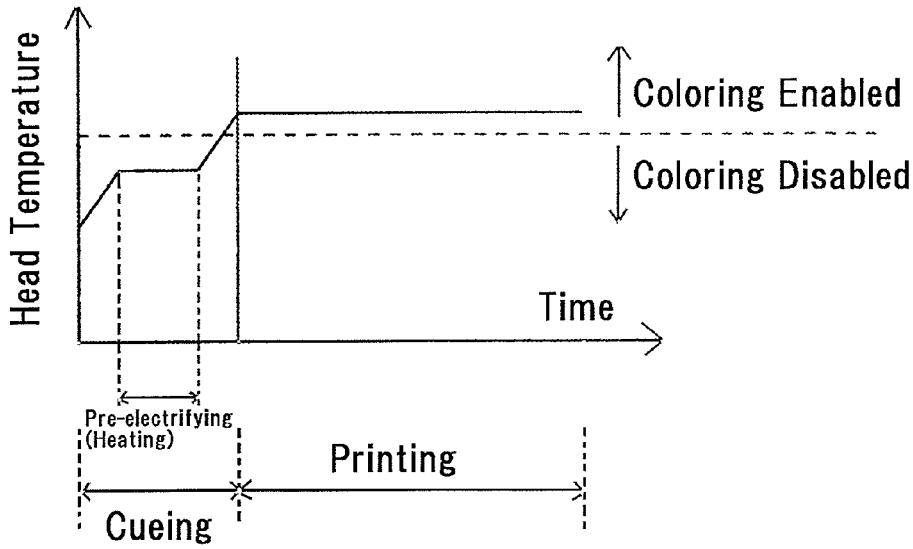
FIG. 8 is an explanatory diagram, for which the horizontal axis represents time and the vertical axis represents the temperature of the thermal head in order to indicate a relationship relative to pre-electrifying and electrifying of the thermal head.

Furthermore, at step 106, when the conveying of the intermediate transfer film F and the ink ribbon R is continued, and when both the intermediate transfer film F and the ink ribbon R have reached the printing start position, as shown in FIG. 7(A) (since the motor controller 40E performs time management for the DC motor and pulse management for the stepping motor, it is possible to ascertain that the intermediate transfer film F has reached the printing start position), the heating elements included in the thermal head 9 are selectively heated to begin image forming for the intermediate transfer film F (also see FIG. 8). This state is shown in FIG. 6(E); however, strictly speaking, since colors are applied to the ink ribbon R in the order of Y, M, C and Bk, as described above, this state indicates that the cue position of the intermediate transfer film F for one image plane and the cue position of Y on the ink ribbon R reach the printing start position. This aligning process will be described later.

When conveying of the intermediate transfer film F and the ink ribbon R further continues, and image forming for the intermediate transfer film F for one image plane is completed (the state shown in FIG. 6(E); also see FIG. 8), the processing advances to the next step 108. The printing routine in FIG. 5 is an example routine that employs one color, Bk; however, when color printing using three colors, Y, M and C, is performed, at step 108, the thermal head 9 is moved to the retracted position (the thermal head 9 and the platen roller 12 are released from each other), information output by the first mark detection sensor 10 and the second mark detection sensor 11 is monitored, while the intermediate transfer film F is conveyed in reverse until the first mark reaches upstream, in the direction in which the intermediate transfer film F was conveyed during image forming, of the position where the first mark detection sensor 10 is arranged, and the ink ribbon R is conveyed in reverse, so that the leading edge of the ink ribbon R for the succeeding ink color (M) is aligned with the initial position of the intermediate transfer film F (see FIG. 6(F)).

At step 108, the intermediate transfer film F and the ink ribbon R are conveyed in reverse until the portion of the intermediate transfer film for one image plane and the portion of the ink ribbon R for the next ink color (M) reach the initial positions shown in FIG. 6(A). At this time, in the state shown in FIG. 6(D), the distance between the initial position of the intermediate transfer film F and the printing start position is calculated, and based on the calculation, reverse conveying is performed, so that, in the state shown in FIG. 6(D), the position of the intermediate transfer film F for one image plane and the position of the ink ribbon for the next ink color (M) are aligned with the printing start position.

This distance calculation will be described while referring to (A) and (B) in FIG. 7. When printing of Y is performed, the position for Y on the ink ribbon R is aligned with the initial position in FIG. 6(A), so that in the state shown in FIG. 6(D), the printing start position of the intermediate film F is aligned with the printing start position for Y. At this time, the distance from the initial position of the intermediate transfer film F to the printing start position is calculated in advance, and based on this distance, the initial position for the ink ribbon R is determined. When printing for Y has been completed, the thermal head 9 and the platen roller 12 are released from each other, and the intermediate transfer film F is conveyed upstream of the above described pressure-contact position until the first mark detection sensor 10 detects the first mark on the intermediate transfer film F (the intermediate transfer film F is again positioned at the initial position described above). Thereafter, the initial position of the ink ribbon R for printing the next ink color M is determined, so as to align the printing position for M with the printing start position of the intermediate transfer film F, as shown in the state in FIG. 6(D) (aligning is performed). Following this, the thermal head 9 is again brought into contact with the platen roller 12, and in the re-contact state, the ink ribbon R and the intermediate transfer film F are conveyed, the first mark is re-detected, and following Y, printing (image forming) for M is begun. The same processing is performed for the next color, C. It should be noted that the absolute position of the ink ribbon R is managed by the second mark detection sensor 11 through the detection of Bk, and so long as cueing of the thus positioned intermediate transfer film F is performed without any displacement, degrading of the printing quality does not occur.

When image forming for the intermediate transfer film F using the three colors Y, M and C has been performed in the above described manner, the printing routine is returned to step 102. Then, the CPU performs a transfer process, during which an image formed on the intermediate transfer film F is carried to the image transfer section, and the transfer of the image to a card is performed by the image forming section.

In the transfer process, first, the card supply roller 18 is rotated to feed a blank card to the card conveyance path. The first and second card conveyance roller pairs, the platen roller 27 and the card conveyance drive rollers 19, all of which are arranged along the card conveyance path, are rotated at the same time as the card supply roller is rotated, and encourage conveyance of a blank card to the card rotation section 4 along the card conveyance path. When the trailing edge of the blank card in the conveyance direction is detected by the transfer positioning sensor 15, the CPU halts the rotation of the card supply roller 18. Further, when the leading edge of the blank card in the conveyance direction is detected by the card rotation positioning sensor 17, the CPU rotates the two pitch roller pairs of the card rotation section 4. After the card rotation positioning sensor 17 has detected the leading edge of the blank card in the conveyance direction and when the blank card has been conveyed along the card conveyance path a predetermined distance, the rollers arranged along the card conveyance path and the two pinch roller pairs of the card rotation section 4 are halted. As a result, the blank card is held by the two pinch roller pairs of the card rotation section 4.

Thereafter, the CPU examines control information stored in the buffer memory 40 to determine whether the blank card is a magnetic card or an IC card, and based on the determination results, pivots the card rotation section 4 a predetermined angle and feeds the blank card to the magnetic writing section 23 or the IC writing section 24. Further, after information has been written to the blank card, the CPU receives the resultant card from the magnetic writing section 23 or the IC writing section 24, and based on the verification results, determines whether the card either should be conveyed to the eject box 25, or should be conveyed in the reverse direction to the first card conveyance roller pair along the card conveyance path. It should be noted that, when it is determined that the card should be conveyed toward the eject box 25, the card is conveyed to the eject box 25, and thereafter, the above described transfer process is again performed, from the beginning.

When it is determined that the card is to be conveyed in the reverse direction, along the card conveyance path, to the first card conveyance roller pair, the two pinch roller pairs of the card rotation section 4 and the rollers arranged along the card conveyance path are reversely rotated, and the card is conveyed in the reverse direction along the card conveyance path. When the card rotation positioning sensor 17 detects the trailing edge of the card in the reverse conveyance direction, the reverse rotation of the two pinch roller pairs of the card rotation section 4 is halted, and when the card supply sensor 15 detects the leading edge of the card in the reverse conveyance direction, the reverse rotation of the rollers arranged along the card conveyance path is halted. As a result, the card is temporarily clamped by the first and second card conveyance roller pairs. Following this, the CPU rotates the rollers arranged along the card conveyance path, so that the card sandwiched by the first and second card conveyance roller pairs is again conveyed downstream along the card conveyance path. When the card positioning sensor 16 detects the leading edge of the card in the conveyance direction, the rotation of the rollers arranged along the card conveyance path is halted. As a result, the card is clamped by the first and second card conveyance roller pairs.

After the card is clamped by the first and second card conveyance roller pairs (this is done because of the need to avoid the degrading of the printing quality of an image that has been formed on the intermediate transfer film F, to which pressure is locally applied by the nip rollers 21 when the conveying of the image-bearing intermediate transfer film F is temporarily halted and is then resumed), the CPU moves the nip rollers 21 to the nip positions, and conveys to the image transfer section the intermediate transfer film F, on which an image for one image plane has been formed by the image forming section. This conveying process is performed while the motor M2 and the stepping motor M3 are driven, and the transfer positioning sensor 14 is performing the detection of the first mark. Before the conveying process, the CPU heats the heating lamp of the heat controller 20, and moves the heating lamp to the forward position.

When the transfer positioning sensor 14 detects the first mark, the CPU rotates the rollers located along the card conveyance path, and conveys, to the image transfer section, the card clamped by the first and second card conveyance roller pairs. As a result, at the same speed, the intermediate transfer film F and the card are conveyed to the image transfer section, while the card is supported from below (on the reverse side) by the rotating platen roller 27, and the upper side (the obverse side) of the card is heated by the heating lamp 20 via the image forming portion of the intermediate transfer film F for one image plane. Thus, an image for one image plane of the intermediate transfer film F is transferred to the card.

After image transferring is completed, the card is conveyed further downstream, and when the card rotation positioning sensor 17 detects the leading edge of the card in the conveyance direction, the CPU rotates the two pinch roller pairs of the card rotation section 4, and when the card rotation positioning sensor 17 detects the trailing edge of the card in the conveyance direction, the CPU halts the rotation of the two pinch roller pairs of the card rotation section 4 and the rollers arranged along the card conveyance path. As a result, the card is again clamped by the card rotation section 4.

Subsequently, the CPU rotates, at 180°, the card rotation section 4 that is holding the card. Therefore, the card is inverted and the lower side (the reverse side) is now positioned as the obverse side. Thereafter, the card is to be conveyed to the first card conveyance roller pair in the reverse direction, and is to be sandwiched between the first and second card conveyance roller pairs, and since this control process has been already described, no further explanation for this will be given.

Generally, in many cases, since information associated with a card is printed on the reverse side of the card, this case will also be explained for this embodiment. When the above described printing routine is performed using one color, Bk, an image for one image plane is formed on the intermediate transfer film F. This differs from the contents of the printing routine described above; however, since the other processing contents are the same, an explanation for the processing will not be given. Further, the transfer process differs in that a blank card is not supplied from the card supply section 3, and in that the recording of magnetic information or electronic information on a blank card is not performed, and since the card is already clamped by the first and second card conveyance roller pairs, all that is required is that the image transfer section performs image transferring from the intermediate transfer film F to the reverse side of the card, and an explanation for this process will not be given to avoid repetition.

When image transferring to the reverse side of the card is completed, the card is continuously conveyed downstream, and when the card rotation positioning sensor 17 detects the leading edge of the card in the conveyance direction, the CPU rotates the two pinch roller pairs of the card rotation section 4. As a result, the card is discharged from the card rotation section 4 to outside the printing device 1, via a discharge port that is formed in the cabinet 2 in the vicinity of the card rotation section 4. At this position, generally, a tray is placed to receive a card to which an image has been transferred.

When the card rotation positioning sensor 17 has detected the trailing edge of the card in the conveyance direction and a predetermined period of time has elapsed, the CPU halts the rotation of the rollers arranged along the card conveyance path and the two pinch roller pairs of the card rotation section 4, drives the motor M1 to rewind the intermediate transfer film F to a predetermined position (the initial position shown in FIG. 6(A)), and stores in the nonvolatile memory the positioning information for an unused image plane of the intermediate transfer film F. Thereafter, the printing for a single card is terminated.

<Operating Effects and Others>

The operating effects, etc., of the printing device 1 of this embodiment will now be described.

According to the printing device 1 of this embodiment, when (or after, as needed) the intermediate transfer film F and the ink ribbon R that are conveyed have reached the printing start positions, the heating elements included in the thermal head 9 are selectively heated to perform image forming for the intermediate transfer film F, without the conveying of the intermediate transfer film F and the ink ribbon R being halted. Therefore, even when the thermal head 9 and the platen roller 12 are pressed against each other to cause a change of the trajectory, the printing start position of the intermediate transfer film F is not shifted, and since the conveying of the intermediate transfer film F and the ink ribbon R is not halted until image forming has been performed, not only the conveying speed for the intermediate transfer medium conveyance section and the ink ribbon conveyance section is stabilized, but also a slackness in the intermediate transfer film F or the ink ribbon R does not occur and a constant back tension is maintained, so that the printing quality can be improved.

Further, according to the printing device 1 of this embodiment, the second mark detection sensor 11 is provided to detect the second mark (Bk) formed on the ink ribbon R, and while the intermediate transfer film F and the ink ribbon R are being conveyed, information output by the first mark detection sensor 10 and the second mark detection sensor 11 is monitored, so that the thermal head 9 is moved to the printing position in the state wherein the first mark has not yet been detected, or that selective heating is performed for the heating elements included in the thermal head 9 in the state wherein the first mark has been detected, i.e., wherein the first mark is located downstream of the location where the first mark detection sensor 10 is arranged, and when or after both the intermediate transfer film F and the ink ribbon R have reached the printing start position. Therefore, the printing quality for color printing can be improved.

Furthermore, according to the printing device 1 of this embodiment, since pre-electrifying of the thermal head 9 is performed after the first mark detection sensor 10 has detected the first mark and before selective heating is performed for the heating elements of the thermal head 9, printing can be immediately performed when the intermediate transfer film F has reached the printing start position, and degrading of the printing quality does not occur.

Moreover, according to the printing device 1 of this embodiment, a plurality of ink colors are applied to the ink ribbon R in sequential panels, and after the printing of one color has been completed, the thermal head 9 is moved to the retracted position, and while information output by the first mark detection sensor 10 and the second mark detection sensor 11 is being monitored, the intermediate transfer film F is conveyed in the reverse direction until the first mark reaches upstream of the location where the first mark detection sensor 10 is arranged, in the conveyance direction employed for image forming for the intermediate transfer film F, and the ink ribbon R is conveyed in the reverse direction until the ink ribbon portion for the succeeding ink color reaches upstream of the location where the second mark detection sensor is arranged, in the conveyance direction employed for image forming. For printing, a plurality of ink colors applied on the ink ribbon R are imposed on the printing area of the intermediate transfer film F for one image plane, and when the feeding and positioning of the intermediate transfer film F is not accurate, the printing start position is shifted each time ink is imposed. However, according to the printing device 1 of this embodiment, since feeding and positioning of the intermediate transfer film F and the ink ribbon R is performed after the thermal head 9 has been lowered, the intermediate transfer film F is not shifted from the printing start position. Further, since the location of the ink ribbon R is calculated in advance, and the ink ribbon R is conveyed in the reverse direction (rewound) so as to be aligned with the printing start position of the intermediate transfer film F, the printing quality can be improved.

Further, according to the printing device 1 of this embodiment, since the absolute location of the ink ribbon R is managed by forming the second mark using ink Bk of the plurality of ink colors that are applied to the ink ribbon R in sequential panels, feeding and positioning for the next ink color can be performed in consonance with the intermediate transfer film F, and a positioning mark for individual ink is not required.

Figure 9:
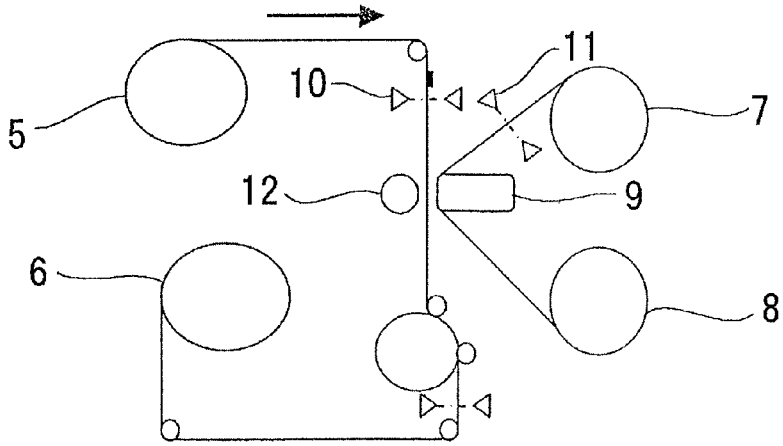
FIG. 9 is a schematic front view showing the arrangement of the main section of a printing device for another embodiment for which the present invention can be applied.
Figure 10:
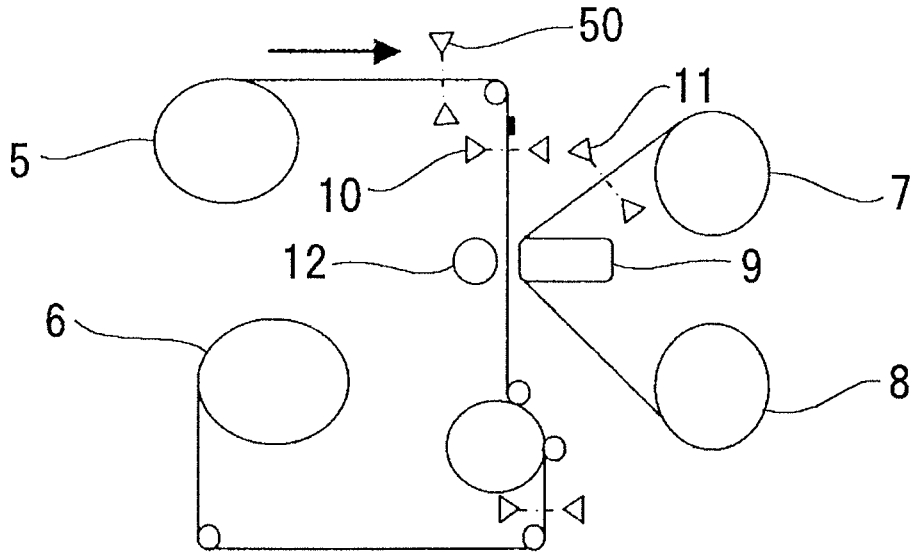
FIG. 10 is a schematic front view of the arrangement of the main section of a printing device for an additional embodiment for which the present invention can be applied.
Figure 11:
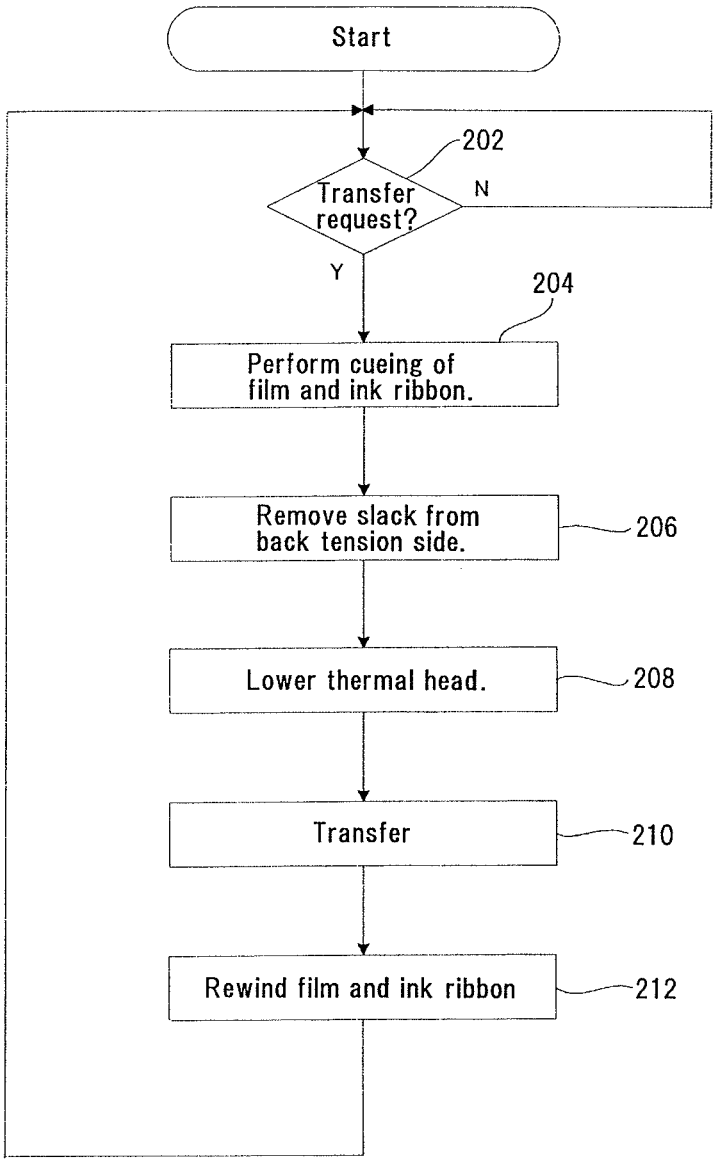
Fig. 11 Prior Art
FIG. 11 is a flowchart for a printing routine performed by the microcomputer of the control section of a conventional printing device.
Figure 12:
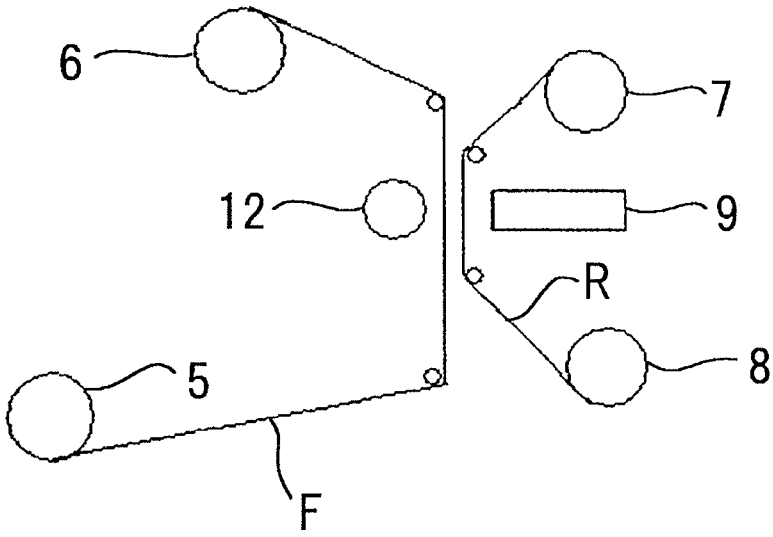
Fig. 12 Prior Art
FIG. 12 is a schematic explanatory diagram showing a retracted position, for the conventional printing device, where the thermal head and the platen roller are separated from each other.
Figure 13:
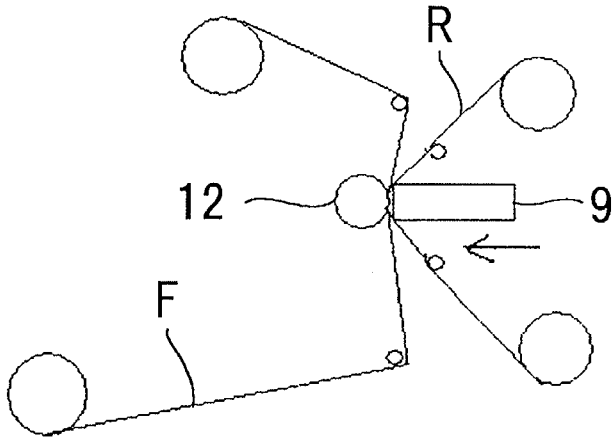
Fig. 13 Prior Art
FIG. 13 is a schematic explanatory diagram showing a printing position, for the conventional printing device, where the thermal head and the platen roller are pressed against each other.
Figure 14:
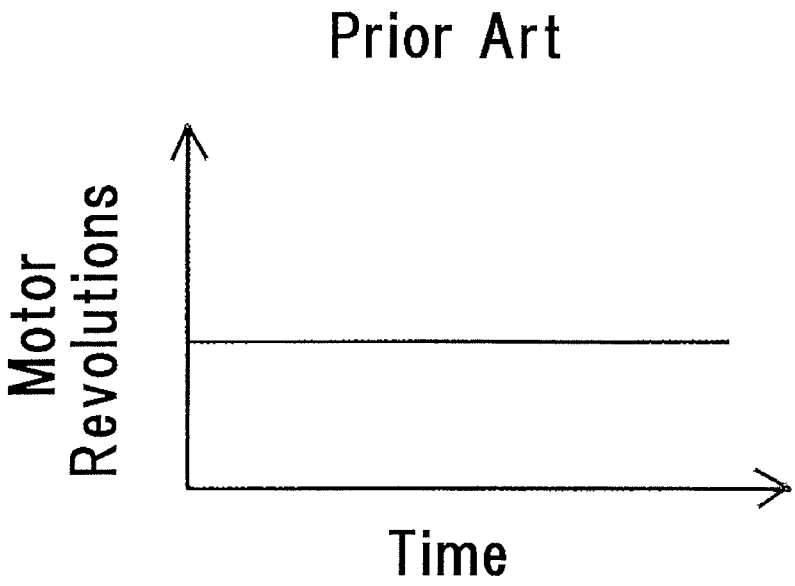
FIG. 14 is a characteristic diagram showing a relationship, relative to time, of the revolutions of a low-speed motor that serves as a drive source for conveying the intermediate transfer film of the conventional printing device.

For this embodiment, an example wherein the film winding portion 6 is located above the film supply portion 5 has been employed; however, the present invention is not limited to this, and as shown in FIGS. 9 and 10, the locations of the film supply portion 5 and the film winding portion 6 may be exchanged. In this case, referring to FIG. 9, the intermediate transfer film F is conveyed in a direction indicated by an arrow, and when the first mark has passed the first mark detection sensor 10, is temporarily conveyed in the reverse direction, and when the first mark has again passed the first mark detection sensor 10, conveying of the intermediate transfer film F is halted. Referring to FIG. 10, a first mark detection second sensor 50 is additionally provided, and when conveying of the intermediate transfer film F is performed in a direction indicated by an arrow, and when the first mark has passed the first mark detection second sensor 50, and thereafter the intermediate transfer film F is conveyed a predetermined distance, conveying of the intermediate transfer film F is halted.

Figure 16:
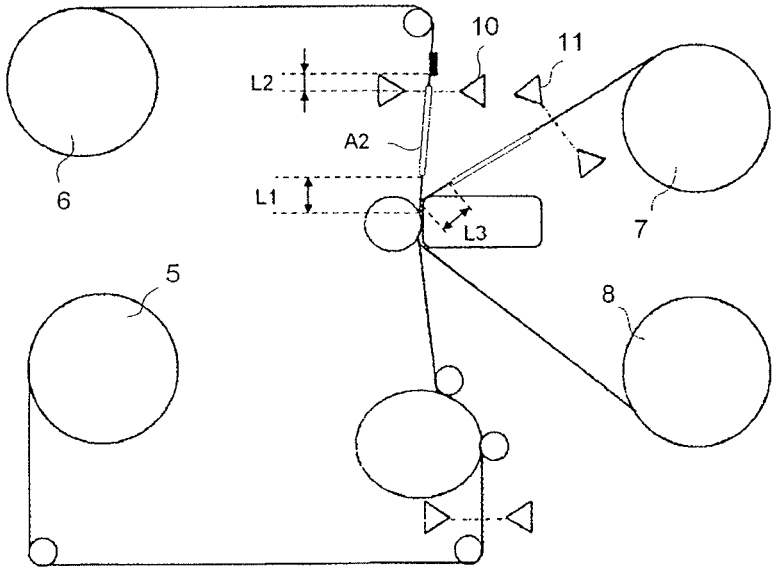
FIG. 16 is a schematic front view showing the arrangement of the main section of the printing device for a further embodiment for which the present invention can be applied.

Furthermore, for this embodiment, an example has been employed wherein the printing area of the intermediate transfer film F is located downstream of the first mark in the film conveyance direction employed for image forming. However, the printing area of the intermediate transfer film F may be located upstream of the first mark (see FIG. 16). In this case, when a distance between the printing start position of the intermediate transfer film F and the platen roller 12 is denoted by L1 (10 mm in this embodiment), and a distance between the first mark and the first mark detection sensor 10 is denoted by L2 (5 mm in this embodiment), the first mark, the printing area and the first mark detection sensor 10 can be set at positions for which a relationship L1>L2 is established. Further, as well as in this embodiment, the initial position of the ink ribbon R is set, so that L1=L3 is established, wherein a distance between the leading edge of the ink ribbon R (e.g., color Y) and the platen roller 12 is denoted by L3. As a result, since printing can be started immediately after the first mark has passed the first mark detection sensor 10, accuracy for the cueing the intermediate transfer film F and the ink ribbon R can be further improved.

Figure 17:
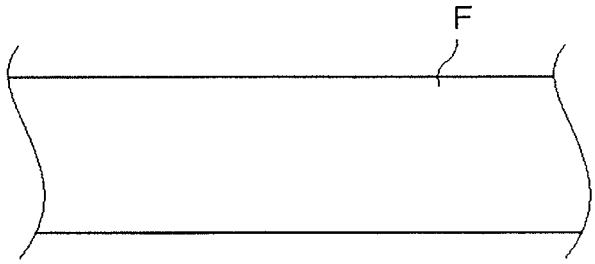
FIG. 17 is a plan view showing the processing, performed by the printing device of the further embodiment, for forming on an intermediate transfer film a first mark and a cue mark for the succeeding printing area, with (A) showing the initial state of the intermediate transfer film, (B) showing a first mark forming step and (C) showing a step of forming a cue mark for the succeeding printing area.
Figure 17:
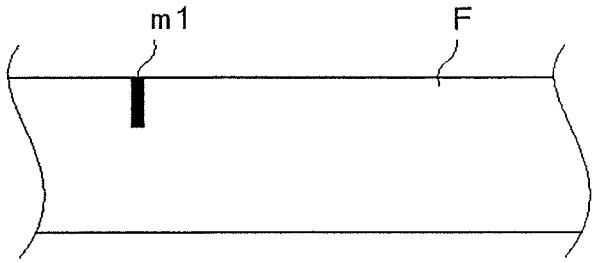
Figure 17:
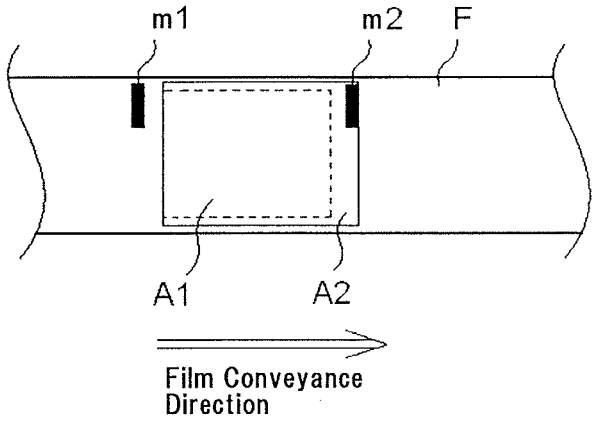

For another embodiment of a printing device of the present invention, Bk on the ink ribbon R may be employed to form the first mark on the intermediate transfer film F. In this case, the first mark has not yet been formed on the intermediate transfer film F in the initial state (FIG. 17(A)), and therefore, when a printer receives a printing instruction, first, a first mark m1 is formed (FIG. 17(B)). Thereafter, cueing of the intermediate transfer film F is performed by employing the mark m1, and an image is formed in an image forming area A1 to be transferred to a card. At this time, when printing of Bk is performed for the printing area, a mark m2 employed for positioning the next printing area is formed upstream of the printing area (upstream in the direction in which the intermediate transfer film is conveyed for image forming) (FIG. 17(C)). At this time, the printing start position of the intermediate transfer film F is a location where the mark m2 is to be printed, and the printing area in this case is not the image forming area A1 that is to be transferred to the card, but a printing area A2 that covers the mark m2 and the image forming area A1 (FIG. 17(C)). Therefore, the above described distance L1 is the distance between the printing start position of the printing area A2 (the position where M2 is to be printed) and the platen roller 12. The initial position of the ink ribbon R is designated based on this distance L1. As a result, the first mark need not be formed in advance for the intermediate transfer film F, and costs can be reduced.

Moreover, in this embodiment, an example where the thermal head 9 is pressed against the platen roller 12 has been employed; however, the present invention is not limited to this, and a platen roller 12 may be pressed against the thermal head 9. Further, a platen is not necessarily a rotary member, and a member that does not adversely affect the conveying of the intermediate transfer film F and the ink ribbon R is preferable.

Additionally, for this embodiment, an example has been described wherein DC motors are employed for film and ribbon supply portions and winding portions; however, a single DC motor may be employed for the supply portions and for the winding portions by using a gear mechanism.

Further, in this embodiment, an example has been provided wherein the second mark detection sensor 20 detects Bk (black) as the second mark; however, the present invention is not limited to this, and instead of ink, various other guides (marks), such as points or lines, may be employed as the second mark. Similarly, an example wherein the first mark is a linear mark has been employed; however, an arbitrary mark may be employed.

INDUSTRIAL APPLICABILITY

Since the present invention provides a printing device that performs high quality printing, and a printing method therefor, and contributes to the production and sale of printing devices, the present invention is industrially applicable.

What is claimed is:

1. A printing device, for pressing a thermal head and a platen against each other, via an ink ribbon, to form an image on a film-shaped intermediate transfer medium, and for transferring the thus obtained image to a printing medium, comprising:

a printing section, including the thermal head and the platen, and being movable between a retracted position, whereat the thermal head and the platen are separated, and a printing position, whereat the thermal head and the platen are pressed against each other;

an intermediate transfer medium conveyance section, for conveying the intermediate transfer medium;

an ink ribbon conveyance section, for conveying the ink ribbon;

a first mark detection section, for detecting a first mark formed on the intermediate transfer medium; and a control section, for controlling the printing section, the intermediate transfer medium conveyance section and the ink ribbon conveyance section based on information output by the first mark detection section, wherein the control section permits the intermediate transfer medium conveyance section and the ink ribbon conveyance section to convey the intermediate transfer medium and the ink ribbon, and concurrently controls the printing section by monitoring information output by the first mark detection section, so that the printing section is moved to the printing position in a state wherein the first mark has not yet been detected where the first mark is located upstream of a position whereat the first mark detection section is arranged, and controls the printing section such that heating elements included in the thermal head are selectively heated in a state wherein the first mark is detected where the first mark is located downstream of the position whereat the first mark detection section is arranged, and when, or after, the intermediate transfer medium has reached a printing start position.

2. The printing device according to claim 1, further comprising:

a second mark detection section for detecting a second mark formed on the ink ribbon, wherein the control section monitors information output by the first and second detection sections to control the intermediate transfer medium conveyance section and the ink ribbon conveyance section so that in the state wherein the information has not yet been detected, a predetermined position of the ink ribbon is aligned with a predetermined position of the intermediate transfer medium, and thereafter to control the printing section such that the printing section is moved to the printing position, and in the state wherein the first mark has been detected where the first mark is present downstream of the position whereat the first mark detection section is arranged, and when, or after, the intermediate transfer medium and the ink ribbon have reached the printing start position, the control section controls such that the heating elements included in the thermal head are selectively heated.

3. The printing device according to claim 2, wherein:

the ink ribbon is provided by applying a plurality of ink colors in sequential panels; and after printing of one color has been completed, the control section may move the printing section to the retracted position, and may monitor information output by the first and second mark detection sections and control the intermediate transfer medium conveyance section and the ink ribbon conveyance section, so that the intermediate transfer medium is conveyed in a reverse direction until the first mark reaches a position upstream of the position whereat the first mark detection section is arranged, in a direction in which the intermediate transfer medium is conveyed during image forming, and that the predetermined position of the ink ribbon for the following ink color is aligned with the predetermined position of the intermediate transfer medium.

4. The printing device according to claim 3, wherein the second mark is formed using one of the plurality of ink colors that are applied in the sequential panels.

5. The printing device according to claim 1, wherein the control section permits the printing section to pre-electrify the thermal head after the first mark detection section has detected the first mark and before the heat elements included in the thermal head are to be selectively heated.

6. A printing device, for pressing a thermal head and a platen against each other, via an ink ribbon, to form an image on a film-shaped intermediate transfer medium, and for transferring the thus obtained image to a printing medium, comprising:

a printing section, including the thermal head and the platen, and being movable between a retracted position, whereat the thermal head and the platen are separated, and a printing position, whereat the thermal head and the platen are pressed against each other;

an intermediate transfer medium conveyance section, for conveying the intermediate transfer medium;

an ink ribbon conveyance section, for conveying the ink ribbon;

a first mark detection section, for detecting a first mark formed on the intermediate transfer medium; and a control section, for controlling the printing section, the intermediate transfer medium conveyance section and the ink ribbon conveyance section based on information output by the first mark detection section, wherein the control section controls the printing section, the intermediate transfer medium conveyance section and the ink ribbon conveyance section, so that when the first mark detection section has detected the first mark, the printing section is moved to the printing position, and thereafter, when the first mark has been detected by the first mark detection section during conveyance of the intermediate transfer medium and the ink ribbon, a printing process is begun, while conveying of the intermediate transfer medium and the ink ribbon is continued.

7. The printing device according to claim 6, wherein:

the control section controls the printing section and the intermediate transfer medium conveyance section, so that after the first mark detection sensor has detected the first mark and before the printing section is to be moved to the printing position, the intermediate transfer medium is conveyed to a location for which a relationship L1>L2 is established, where L1 denotes a distance from a leading edge of a printing area to the printing section and L2 denotes a distance from the first mark to the first mark detection section.

8. The printing device according to claim 6, further comprising:

a second mark detection section for detecting a second mark formed on the ink ribbon, wherein the control section controls the intermediate transfer medium conveyance section and the ink ribbon conveyance section, so that after the first mark detection sensor has detected the first mark and before the printing section is to be moved to the printing position, the intermediate transfer medium and the ink ribbon are conveyed to a location for which a relationship L1>L2 and L1=L3 is established, where L2 denotes a distance from the leading edge of the printing area to the printing section, L2 denotes a distance from the first mark to the first mark detection section, and L3 denotes a distance from the printing start position of the ink ribbon to the printing section.

9. The printing device according to claim 8, wherein:

the ink ribbon is provided by applying a plurality of ink colors in sequential panels; and after the printing of one color has been completed, the control section moves the printing section to a retracted position, permits the intermediate transfer medium conveyance section to perform reverse conveying of the intermediate transfer medium until the first mark passes the first mark detection section, and permits the ink ribbon conveyance section to convey the ink ribbon, based on information output by the second mark detection section, to a position such that a distance from the printing start position for the next color of the ink ribbon to the printing section is equal to L1.

10. The printing device according to claim 9, wherein the second mark is formed using at least one of the plurality of ink colors applied in sequential panels.

11. A printing method, for pressing a thermal head and a platen against each other via an ink ribbon to form an image on a film-shaped intermediate transfer medium, and for transferring the obtained image to a printing medium, comprising:

a detection step of conveying the intermediate transfer medium and detecting a first mark formed on the intermediate transfer medium, while the thermal head and the platen are not pressed against each other;

a pressing step of employing first mark detection information, obtained at the detection step, and pressing one of the thermal head and the platen against the other via the ink ribbon and the intermediate transfer medium;

a conveyance step of conveying the ink ribbon and the intermediate transfer medium, while the thermal head and the platen are being pressed against each other;

a re-detection step of again detecting the first mark formed on the intermediate transfer medium; and an image forming step of employing first mark detection information, obtained at the re-detection step, and beginning image forming on the intermediate transfer medium while the thermal head and the platen are pressed against each other, wherein, when conveying of the ink ribbon and the intermediate transfer medium has begun at the conveyance step, the mark re-detection step and the image forming step are performed, without halting the conveying of the intermediate transfer medium and the ink ribbon.

12. The printing method according to claim 11, further comprising, before the pressing step:

an alignment step of detecting a second mark, formed on the ink ribbon, to align the intermediate transfer medium and the ink ribbon.

13. The printing method according to claim 11, wherein:

a plurality of ink colors that are employed to form a plurality of color images on the intermediate transfer medium are applied to the ink ribbon in sequential panels, and in addition, the second mark for position detection is formed on the ink ribbon; and the image forming step includes a contact pressure release step of, after image forming for the intermediate transfer medium has been completed using one of the plurality of ink colors on the ink ribbon, releasing a pressure that is applied to hold the thermal head and the platen in contact with each other, a moving step, in a state wherein a contact pressure applied to the thermal head and the platen has been released, of moving the intermediate transfer medium upstream from a pressure-contact position whereat the thermal head and the platen are pressed against each other, an alignment step of detecting the first mark formed on the intermediate transfer medium and the second mark formed on the ink ribbon, and of aligning the intermediate transfer medium with the ink ribbon, a re-contact pressing step of employing first mark detection information, obtained at the alignment step, and again pressing one of the thermal head and the platen against the other via the ink ribbon and the intermediate transfer medium, a conveyance step of conveying the ink ribbon and the intermediate transfer medium while the thermal head and the platen are pressed against each other, a re-detection step of again detecting the first mark formed on the intermediate transfer medium, and a succeeding ink image forming step, in a state wherein the thermal head and the platen are again pressed against each other, of employing first mark detection information, obtained at the re-detection step, and beginning image forming for the intermediate transfer medium, using an ink color following the one color, of the plurality of ink colors that are applied to the ink ribbon in sequential panels.

14. The printing method according to claim 13, wherein the second mark is formed with at least one of the plurality of ink colors applied in sequential panels.

* * * * *